United States Patent [19]

Kolk et al.

[11] 4,262,871

[45] Apr. 21, 1981

[54] PLASTIC ENCAPSULATED BASE

[75] Inventors: Stephen B. Kolk, Grand Rapids; Kenneth W. Hozeski, Grandville, both of Mich.

[73] Assignee: Steelcase Inc., Grand Rapids, Mich.

[21] Appl. No.: 28,047

[22] Filed: Apr. 6, 1979

[51] Int. Cl.[3] ..... F16M 11/20

[52] U.S. Cl. ..... 248/188.7; 248/345.1

[58] Field of Search ..... 248/188.7, 345.1, 188.9

[56] References Cited

U.S. PATENT DOCUMENTS

| | | | |
|---|---|---|---|
| 2,193,719 | 3/1940 | Foote | 248/345.1 |
| 2,910,803 | 11/1959 | Close | 248/345.1 |
| 2,913,208 | 11/1959 | McKinley | 248/188.7 |
| 3,160,382 | 12/1964 | Lee | 248/188.7 |
| 3,186,669 | 6/1965 | Buhrmaster | 248/188.7 X |
| 3,289,995 | 12/1966 | Taylor | 248/345.1 |
| 3,796,169 | 3/1974 | Bales et al. | 248/188.9 X |
| 3,994,466 | 11/1976 | Troup | 248/188.7 X |
| 4,003,180 | 1/1977 | Messuri | 248/345.1 |
| 4,005,841 | 2/1977 | Reuslaud et al. | 248/188.7 |

*Primary Examiner*—Francis K. Zugel

*Attorney, Agent, or Firm*—Price, Heneveld, Huizenga & Cooper

[57] ABSTRACT

The specification discloses a chair base in which an integrally molded plastic chair base cover includes a base arm cover with a portion extending out and beyond the end of the base arm. The overhanging portion of the base arm cover extends down over and at least partially covers a base arm end plug inserted into the end of the base arm. Fastening means extend through the under surface of the overhanging cover portion and into the base arm end plug to positively secure the molded plastic base cover in place.

17 Claims, 16 Drawing Figures

PLASTIC ENCAPSULATED BASE

BACKGROUND OF THE INVENTION

The present invention relates to chair bases, particularly pedestal type chair bases where base arms radiate from a central hub and are covered or encapsulated with plastic.

For many years, it has been fairly common to provide base arms of pedestal bases with some type of rubber pad or plastic cover. The rubber pads are typically nailed or screwed in place. Some rubber or plastic base arm covers have covered all or substantially all of the base arm.

A problem with such prior art plastic covers is that ugly fasteners are often visible. These fasteners are used to secure the base arm covers in place. In addition or alternatively, manufacturers have difficulty keeping the plastic covers in place on the base arms when the bases are in use in the field. In modern chair bases where the base arms are made of tubular steel, it is particularly difficult to suitably secure the base arm covers to the steel tubes of the base arms.

There is a tendency for prior art chair bases employing plastic base arm covers to look "patchy" or "pieced together". This is true even where attempts are made to cover the entire base. Prior artisans have apparently been unable to satisfactorily secure integrally molded base covers to the underlying steel base. While there may be other reasons for the failure of prior artisans to employ integrally molded base covers wherein all of the base arm covers are molded as part of a single unit, the difficulty of positively securing such a base cover in place has undoubtedly contributed to the failure of prior artisans to employ such integrally molded covers.

SUMMARY OF THE INVENTION

The present invention is a plastic covered base which obviates prior art fastening difficulties and which makes it possible to use an integrally molded plastic cover for the whole base, including all of the radiating base arms. A base arm end plug, which is separate from the base arm cover per se, is inserted into the ends of each tubular metal base arm and the end of the base arm cover overhangs and at least partially covers the end plug. Fastening means extend through the overhanging portion, from the underside thereof, and into the plug, thereby positively securing the base arm cover in place.

These and other objects, advantages and features of the invention will be more fully understood and appreciated by reference to the written specification and appended drawings.

DESCRIPTION OF THE PREFERRED EMBODIMENT

Figure 1:
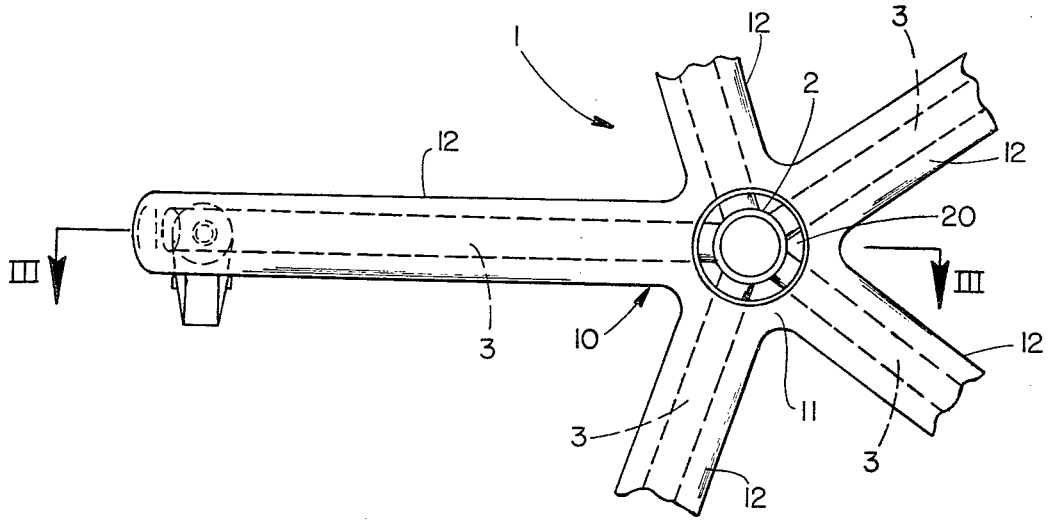
FIG. 1 is a top plan view of a pedestal base made in accordance with the present invention, with the end portions of all but one of the radiating base arms being broken away for convenience.
Figure 2:
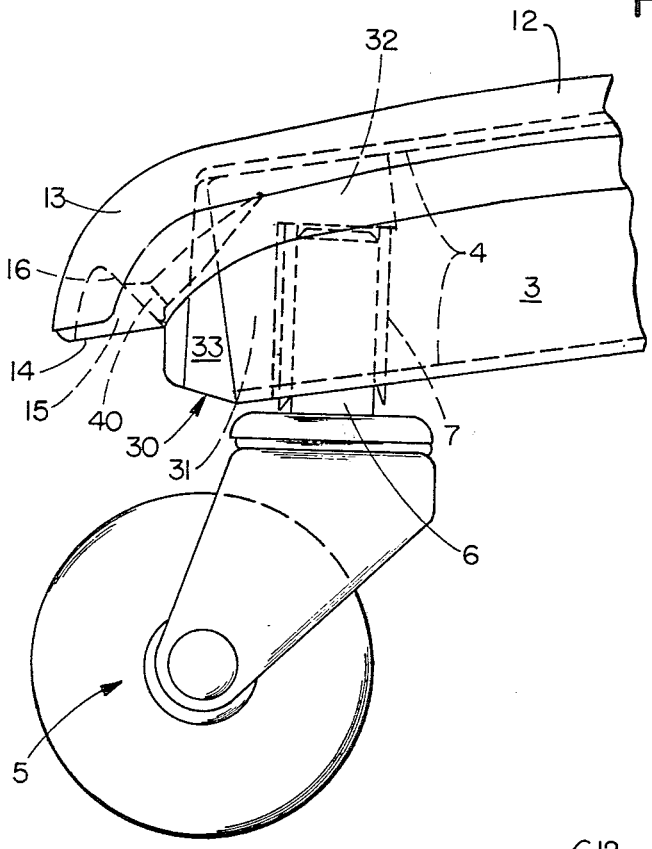
FIG. 2 is a side elevational view of the end portion of a base arm.

Base 1 of the present invention includes a central hub tube 2 and radiating tubular steel base arms 3 as is generally conventional (FIGS. 1 and 2). The open end of each base arm 3 defines a socket 4 for receiving an end plug 30 (FIG. 2). Fitted over the base arms is an integrally molded plastic cover 10 including a central portion 11 and radiating base arm covers 12 (FIG. 1). Each arm cover 12 includes an overhanging end 13 which hangs over the end of base arm 3 and at least partially covers the end of end plug 30. (FIG. 2) A fastener 40, preferably a small screw, extends through overhanging end portion 13 from the underside 14 thereof and extends into end plug 30 to positively secure cover 10 in place.

Plastic cover 10 is preferably integrally molded from any of a number of different plastic materials. It is preferably scuff resistant and yet sufficiently forgiving itself that it does not scuff or mar a user's shoe.

In the preferred embodiment, the central portion 11 of cover 10 serves as a means for molding the individual radiating base arm covers 12 in place at the central hub 2 (FIG. 1). If the arm covers 12 were molded separately rather than integrally with central portion 11, some other means would have to be provided for holding the arm covers in place at the central portion of base 1.

There is a central opening 20 in plastic cover 10 through which hub tube 2 projects. Immediately surrounding central opening 20 is a narrow flat 11*a*.

Figure 3:
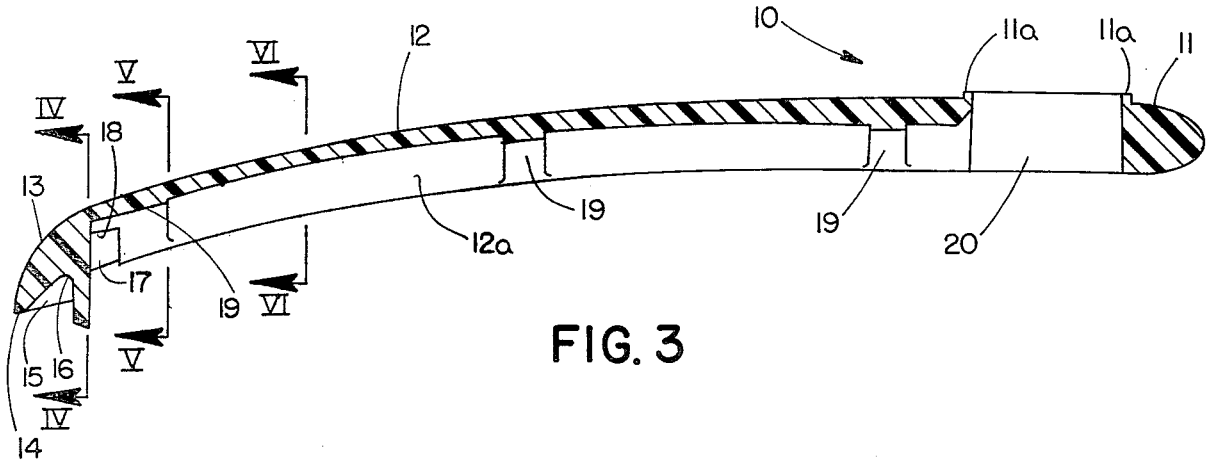
FIG. 3 is a cross sectional view of the plastic cover portion only taken along plane III—III of FIG. 1.

Each overhanging portion 13 of each radiating arm cover 12 includes a recess 15 opening to the underside 14 thereof (FIGS. 2 and 3). Fastener 40 is actually inserted up into this recess 15 such that it is for all practical purposes totally invisible to the user. Each recess 15 includes a sloped wall 16, sloped such that when fastener 40 is inserted therethrough generally at right angles thereto, fastener 40 will proceed on into end plug 30 to create a secure fastening.

Figure 4:
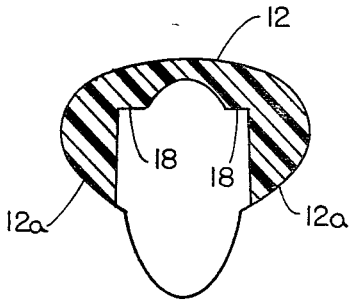
FIG. 4 is a cross sectional view taken along IV—IV of FIG. 3.
Figure 5:
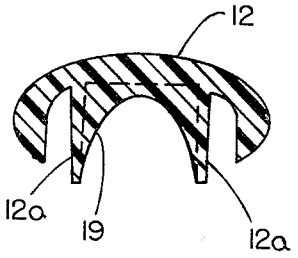
FIG. 5 is a cross sectional view taken along plane V—V of FIG. 3.
Figure 6:
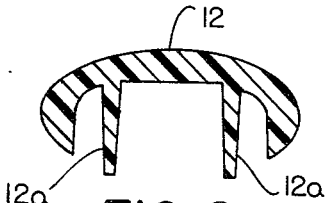
FIG. 6 is a cross sectional view taken along plane VI—VI of FIG. 3.
Figure 7:
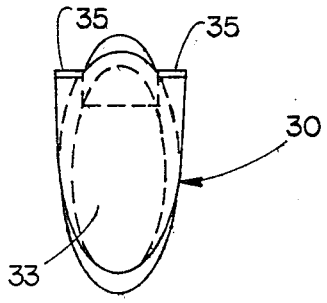
FIG. 7 is an end elevational view of the base arm end plug.

Each radiating base arm cover portion 12 is shaped generally like an inverted U (FIGS. 3–6), such that it has downwardly depending sidewalls 12*a*. Each side wall 12*a* is notched in the area immediately adjacent overhang 13 to define a "land notch" 17 whose upper surface defines a land 18 for cooperating with corresponding lands 35 on end plug 30 (Compare FIGS. 3, 4 and 7). This helps prevent base arm cover 12 from twisting on its underlying base arm 3.

The underside of each base arm cover 12 is also provided with three pads 19, one near each end thereof and one in the middle thereof (FIG. 3). Over most of its length, the shape of the underside of base arm cover 12 does not particularly closely conform to the shape of the underlying base arm. In the preferred embodiment, the cross section of the base arm 3 is generally oval, as can be seen by the shape of end plug 30 (see particularly FIG. 9). Yet over most of its length, base arm cover 12 simply has a generally rectangular configuratin which is easy to mold (see FIG. 6).

In contrast, the pads 19 are relatively short (in length) areas which are shaped to conform exactly to the exterior configuration of each base arm 3. This contour is illustrated particularly well in FIG. 5, and the FIG. 5 cross section is generally similar to the cross sectional configuration of the two other pad areas 19. By utilizing the pads 19 at only certain points and by generally creating a rather significant difference in shape between the underside of the arm cover 12 and most of the base arm 3, one accomplishes two important things. First, one saves plastic material. Secondly, one avoids the necessity of observing extremely close tolerances throughout the whole length of the base arm cover 12.

Figure 8:
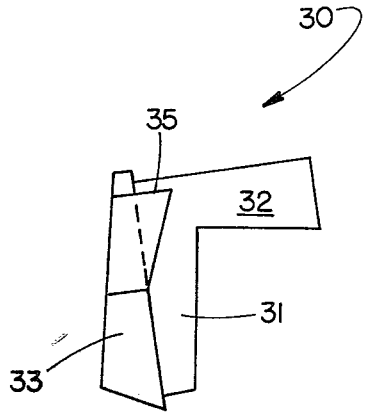
FIG. 8 is a side elevational view of the end plug.

Plug 30 is also molded of plastic, with many suitable plastics being available. Plug 30 comprises a body 31 with a top leg 32 projecting therefrom and with a cap 33 on the side thereof opposite leg 32 (FIG. 8). Lands 35 are located generally at each side edge of cap 33.

Cap 33 is generally wedge shaped in side elevation, tapering from its narrowest point at the top to its widest point at the bottom. This enables one to bring tubular base arms 3 out from hub tube 2 at a downwardly inclined angle and at the same time allows the depending end portion 13 of base arm cover 12 to be molded with a generally vertical inside wall, thereby eliminating any undercuts in molding process. Because cap 33 is wedge shaped, it fills what otherwise would be a gap between the end of the angularly inclined base arm 3 (unless one were to specially cut it off vertically at the end which would require added expense) and the generally vertical inside face of overhang 13 (see FIG. 2). In final assembly, the inside surface of overhang 13 butts directly against the outside surface of cap 33.

Figure 9:
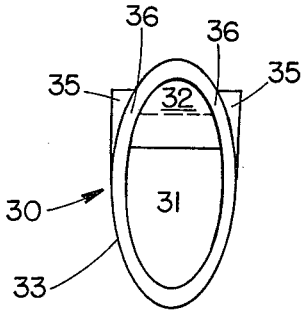
FIG. 9 is an inside end elevational view of the end plug.
Figure 10:
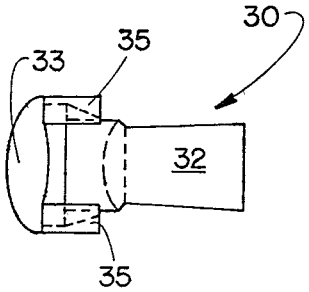
FIG. 10 is a top plan view of the end of the plug.
Figure 11:
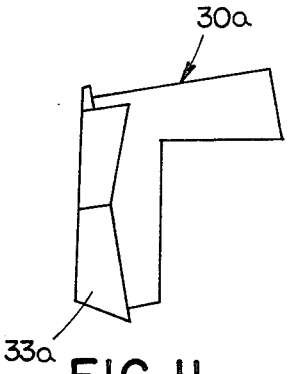
FIG. 11 is a side elevational view of a variation of the FIG. 8 end plug.
Figure 12:
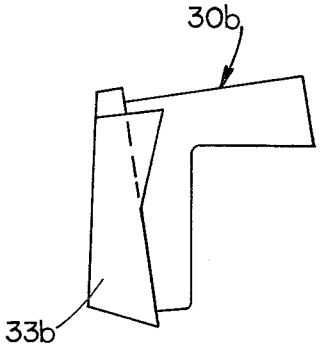
FIG. 12 is a side elevational view of a variation of both the FIG. 8 and FIG. 11 end plugs.

Cap 33 is somewhat larger than plug body 31 as can be particularly well seen by reference to FIGS. 2 and 9. This allows one to inserst plug 30 to its full extent in the socket 4 of radial base arm 3 until the protruding edge of cap 33 comes up against the end of radial tube 3.

Lands 35 actually project inwardly somewhat from the edge of cap 33 so that there is a groove 36 between each land 35 and the main body 31 of plug 30 (FIG. 9). Thus, lands 35 projects past the terminal ends of base arms 3 and towards hub 2 when plug 30 is in place.

Upper leg 32 of plug 30 projects inwardly over the caster pintle tube 7 which projects up into the inside of the socket portion 4 of radial base arm 3 (FIG. 2). Pintle tube 7 receives the caster pintle 6 of caster 5. This added extension on plug body 31 helps to ensure that plug 30 cannot be accidentally slipped out of the end of socket 4 of base arm 3.

As with most base arms, base arm 3 is irregular in cross sectional configuration and plug body 31 and upper leg 32 have an external configuration which mates with the internal configuration of base arms 3. Plug 30 will therefore not rotate within base arm 3. By providing lands 35 on which the lands 18 of base arm cover 12 rest, one helps ensure that base arm cover 12 will not rotate around to one side or the other of base arm 3.

Figure 13:
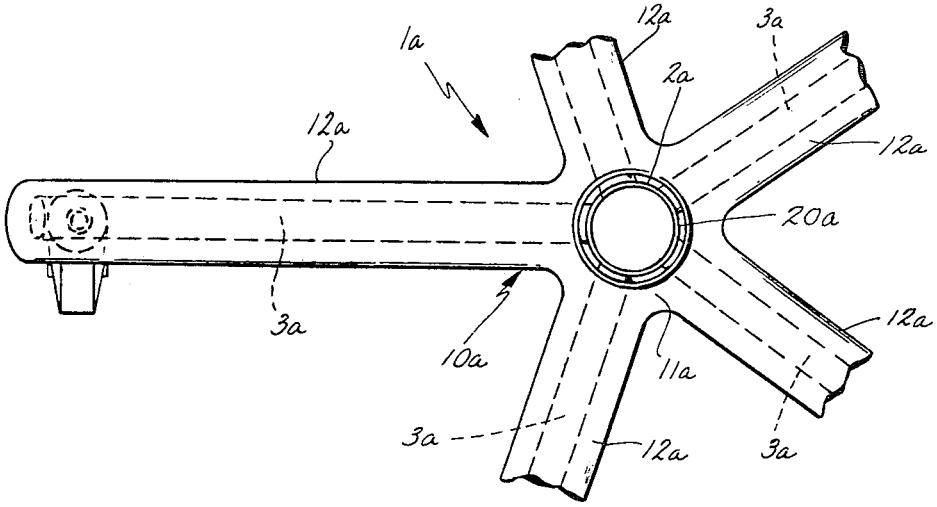
FIG. 13 is a top plan view of a variation of the pedestal base, adaptd for use with the end plug shown in FIG. 11.
Figure 14:
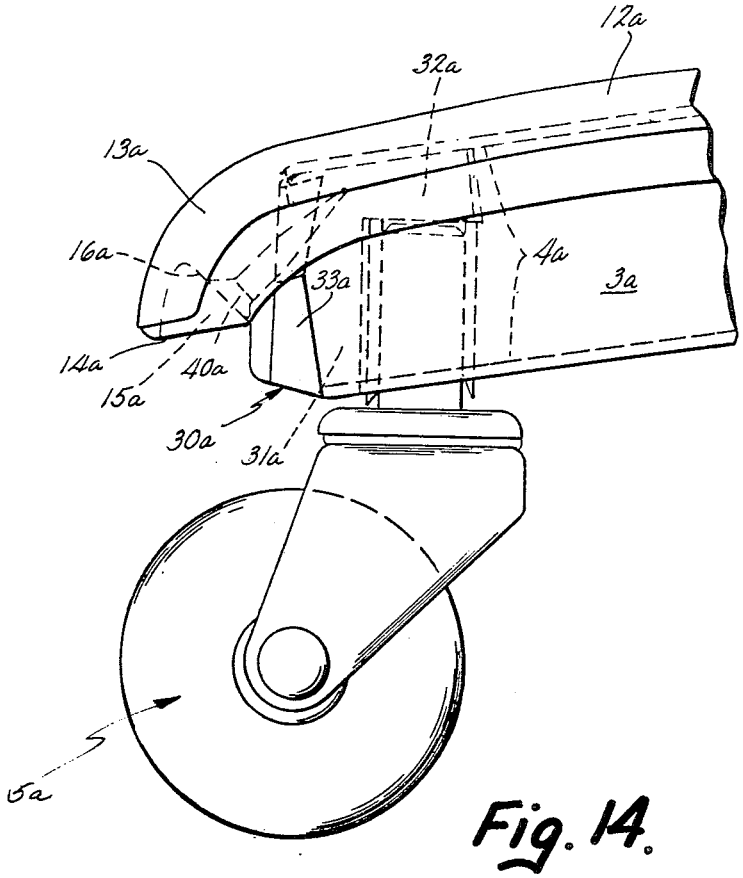
FIG. 14 is a side elevational view of the end portion of the base arm of FIG. 13.
Figure 15:
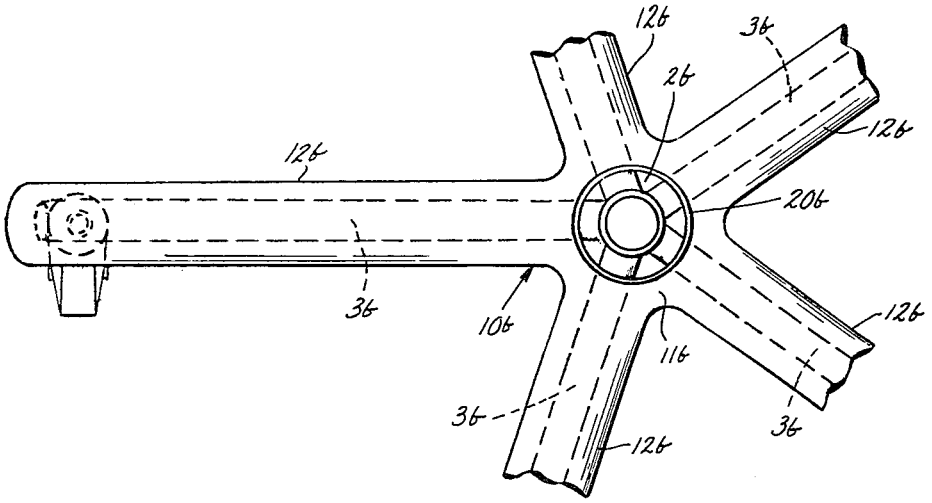
FIG. 15 is a top plan view of another variation of the pedestal base, adapted for use with the end plug shown in FIG. 12.
Figure 16:
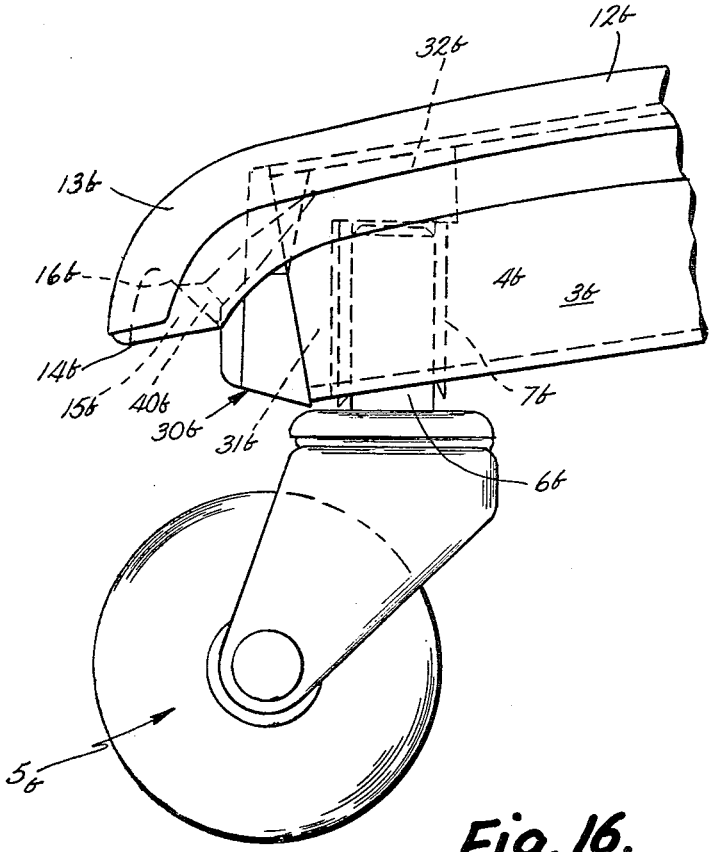
FIG. 16 is a side elevational view of the end portion of the base arm of FIG. 15.

The present invention is adaptable to a complete system of bases which might, for example, employ a narrower or wider diameter central hub tube 2 (FIGS. 15 and 13, respectively). This would change the effective length of base arms 3 relative to the length of arm cover portions 12.

To accomodate this, alternative plugs **30*a* and 30*b* are provided. The only difference between alternative plugs 30*a* and 30*b* from plug 30 is that the wedge shaped cap 33*a* of end plug 30*a* is somewhat narrower than corresponding cap 33 of plug 30. Similarly, cap 33*b* is somewhat wider. Thus by providing several alternative end plugs 30 with different width caps 33, one can use the same base cover 10 on several different bases which might utilize varying diameter central hub tubes 2 or, varying length base arms 3** for that matter.

Since the variations shown in FIGS. 13–14 and 15–16 are otherwise similar to base 1, similar parts appearing in FIGS. 1–10, FIGS. 13–14, and FIGS. 15–16 are represented by the same, corresponding reference numeral, except for the suffixes "a" and "b", respectively, in the numerals of the latter two embodiments.

To assemble base 1, one first inserts plugs 30 into the ends of radiating base arms 3. One then slips base cover 10 down over the subassembly of hub 2 and outer hub tube (not shown) and base arms 3 until the pads 19 come to rest on base arm 3 and overhang 13 extends down so as to cover plug 30. One then threads fastening screw 40 up through the sloped innerwall 16 of recess 15 in the under surface 14 of overhang 13 and continues threading until it is threaded into end plug 30.

Of course, it is understood that the above is merely a preferred embodiment of the invention and that various changes and alterations can be made without departing from the spirit and broader aspects thereof as set forth in the appended claims as interpretted in light of the prior art and in accordance with the doctrine of equivalents.

The embodiments of the invention in which an exclusive property or privilege is claimed are defined as follows:

1. A pedestal type chair base including a central hub, radiating base arms with open sockets at the end thereof and separate plastic cover means including base arm covers covering said base arms, the improvement comprising: each base arm cover including means securing it to said base at said hub; a plug extending into said socket; said base arm cover extending out over said end of said base arm, defining an overhang at least partly covering said plug and having an under surface projecting away from said plug; fastening means extending through said overhang from said under surface thereof and into said plug to thereby secure said base arm cover in place.

2. The pedestal base of claim 1 in which said plastic base cover is integrally molded in one piece.

3. The pedestal base of claim 1 or 2 in which said overhang includes a recess opening at the under surface thereof into which said fastening means is inserted.

4. The pedestal base of claim 3 in which said recess includes an interior wall towards said end plug which is sloped such that when said fastener is inserted therein at generally right angles thereto, it extends through said sloped wall and into said end plug.

5. The pedestal base of claim 4 wherein said end plug includes a cap located outside of said socket and lands projecting from said cap; said base arm cover including mating lands resting on said end plug lands to prevent said base arm cover from slipping to one side or the other of said base arm.

6. The pedestal base of claim 5 in which said lands project from said cap towards said central hub on either side of said base arm whereby a groove is formed between said lands and that portion of said end plug which is within said socket of said base arm.

7. The pedestal base of claim 5 in which said overhang of said base arm end cover has a generally vertical inside wall so that it can be molded without cams; said cap of said end plug being generally wedge shaped in side elevation, tapering from its narrowest point at the top to its widest point at the bottom whereby the end surface of said cap can be generally vertical so as to mate with said inside surface of said overhang and whereby said base arm can be inclined at an angle to the horizontal and its end will still abutt the edge of said cap.

8. The pedestal base of claim 7 in which said base arm includes a caster pintle holder tube projecting upwardly to said socket and said end plug includes a main body located within said socket adjacent said pintle holder tube and an upper leg extending out over the top of said pintle holder tube.

9. The pedestal base of claim 7 combined with an alternative base to create a system of pedestal bases with the effective length of the base arms relative to the length of the base arm covers varying between said two bases of said system; there being two different end plugs for the two different bases having caps of differing thicknesses whereby a single type of said plastic base cover can be utilized for both said bases.

10. The pedestal base of claim 3 in which said base arm cover has generally a different configuration on its under side throughout most of its length from the configuration of the base arm over which it is to be seated such that plastic can be saved and close tolerances are not required, said base arm cover including spaced pad areas spaced along the length of said base arm cover, the interior configuration of said pad areas corresponding to and mating with the exterior configuration of said base arm.

11. The pedestal base of claim 10 combined with an alternative base to create a system of pedestal bases with the effective length of the base arms relative to the length of the base arm covers varying between said two bases of said system; there being two different end plugs for the two different bases having caps of differing thicknesses whereby a single type of said plastic base cover can be utilized for both said bases.

12. The pedestal base of claim 3 wherein said end plug includes a cap located outside of said socket and lands projecting from said cap; said base arm cover including mating lands resting on said end plug lands to prevent said base arm cover form slipping to one side or the other of said base arm.

13. The pedestal base of claim 3 in which said overhang of said base arm end cover has a generally vertical inside wall so that it can be molded without cams; said cap of said end plug being generally wedge shaped in side elevation, tapering from its narrowest point at the top of its widest point at the bottom whereby the end surface of said cap can be generally vertical so as to mate with said inside surface of said overhang and whereby said base arm can be inclined at an angle to the horizontal and its end will still abutt the edge of said cap.

14. The pedestal base of claim 1 or 2 in which said base arm cover has generally a different configuration on its under side throughout most of its length from the configuration of the base arm over which it is to be seated such that plastic can be saved and close tolerances are not required, said base arm cover including spaced pad areas spaced along the length of said base arm cover, the interior configuration of said pad areas corresponding to and mating with the exterior configuration of said base arm.

15. The pedestal base of claim 1 or 2 combined with an alternative base to create a system of pedestal bases with the effective length of the base arms relative to the length of the base arm covers varying between said two bases of said system; there being two different end plugs for the two different bases having caps of differing thicknesses whereby a single type of said plastic base cover can be utilized for both said bases.

16. The pedestal base of claim 1 or 2 wherein said end plug includes a cap located outside of said socket and lands projecting from said cap; said base arm cover including mating lands resting on said end plug lands to prevent said base arm cover form slipping to one side or the other of said base arm.

17. The pedestal base of claim 1 or 2 in which said overhang of said base arm end cover has a generally vertical inside wall so that it can be molded without cams; said cap of said end plug being generally wedge shaped in side elevation, tapering from its narrowest point at the top to its widest point at the bottom whereby the end surface of said cap can be generally vertical so as to mate with said inside surface of said overhang and whereby said base arm can be inclined at an angle to the horizontal and its end will still abutt the edge of said cap.

* * * * *

UNITED STATES PATENT AND TRADEMARK OFFICE

CERTIFICATE OF CORRECTION

PATENT NO. : 4,262,871

DATED : April 21, 1981

INVENTOR(S) : Stephen B. Kolk, et al

It is certified that error appears in the above-identified patent and that said Letters Patent are hereby corrected as shown below:

Column 2, line 14:

"adaptd" should be --adapted--

Column 2, line 35:

Delete the period after the numeral "30" and insert the period after "2)"

Column 3, line 13:

"configuratin" should be --configuration--

Column 3, line 50:

"inserst" should be --insert--

Column 3, line 68:

"arms" should be --arm--

Column 4, line 42:

"interpretted" should be --interpreted--

UNITED STATES PATENT AND TRADEMARK OFFICE

CERTIFICATE OF CORRECTION

PATENT NO. : 4,262,871

DATED : April 21, 1981

INVENTOR(S) : Stephen B. Kolk, et al

It is certified that error appears in the above-identified patent and that said Letters Patent are hereby corrected as shown below:

Column 5, line 23:

"abutt" should be --abut--

Column 6, line 7:

"form" should be --from--

Column 6, line 14:

"of" should be --to--

Column 6, line 18:

"abutt" should be --abut--

Column 6, line 42:

"form" should be --from--

Column 6, line 53:

"abutt" should be --abut--

Signed and Sealed this

*Eighth* Day of *September 1981*

[SEAL]

*Attest:*

GERALD J. MOSSINGHOFF

*Attesting Officer*

*Commissioner of Patents and Trademarks*